US006065265A

United States Patent [19]

Stenekes

[11] Patent Number: 6,065,265

[45] Date of Patent: May 23, 2000

[54] CORNER AND END BLOCK FOR INTERLOCKING BUILDING BLOCK SYSTEM

[75] Inventor: Simon Stenekes, Burlington, Canada

[73] Assignee: Newtec Building Products Inc., Burlington, Canada

[21] Appl. No.: 09/178,418

[22] Filed: Oct. 26, 1998

Related U.S. Application Data

[63] Continuation-in-part of application No. 08/850,105, May 1, 1997, Pat. No. 5,894,702.

[51] Int. Cl.[7] ..... E04C 1/39

[52] U.S. Cl. ..... 52/607; 52/100; 52/592.6; 52/604; 52/606; 52/421

[58] Field of Search ..... 52/100, 284, 421, 52/432, 439, 442, 592.6, 604, 606, 607

[56] References Cited

U.S. PATENT DOCUMENTS

| | | | |
|---|---|---|---|
| 3,888,060 | 6/1975 | Haener . | |
| 3,968,615 | 7/1976 | Ivany | 52/439 |
| 4,107,894 | 8/1978 | Mullins . | |
| 4,319,440 | 3/1982 | Rassias et al. . | |
| 4,372,091 | 2/1983 | Brown et al. . | |
| 4,514,949 | 5/1985 | Crespo . | |
| 4,640,071 | 2/1987 | Haener . | |
| 4,895,472 | 1/1990 | Hunt | 52/592.6 |
| 5,575,128 | 11/1996 | Haener | 52/100 X |

*Primary Examiner*—Christopher T. Kent
*Attorney, Agent, or Firm*—Ingrid E. Schmidt

[57] ABSTRACT

An interlocking building block for use in constructing mortarless walls in which the block has a first face shell in spaced relationship with a second face shell which define opposed inner surfaces for the block. Between the face shells, there stands at least one transversely-disposed bridge portion and a transverse end portion which defines an operatively outer surface for the block and which closes one end of the block between the first and second face shells. A grouting cavity is formed between the transverse end portion and a bridge portion. Both the transversely-disposed bridge portions and the transverse end portion have integrally-formed projections which extend above the height of the block on an operatively-upper surface and corresponding recesses are formed in an operatively lower surface of the block. Channels are formed in the opposed inner surfaces of the face shells which are adapted to receive and locate corresponding projections of an underlying interlocking block which is oriented orthogonally to the block, and the channels also define a reduced wall thickness in the first and second face shells which may be partially broken away to receive a reinforcement bar for reinforcing grout which is added to the grouting cavity.

9 Claims, 8 Drawing Sheets

CORNER AND END BLOCK FOR INTERLOCKING BUILDING BLOCK SYSTEM

This is a continuation-in-part of U.S. application Ser. No. 08/850,105, filed May 1, 1997, and now U.S. Pat. No. 5,894,702.

FIELD OF THE INVENTION

This invention relates to interlocking building blocks for use in the construction of mortarless walls. In particular, the invention relates to blocks used at a comer junction between two walls or as end blocks to form wall endings such as in window and door openings.

BACKGROUND OF THE INVENTION

Interlocking building blocks used in the construction of mortarless walls typically have projections on an upper surface of the block and have corresponding recesses on a lower surface of the block, the projections of one block being adapted to be received in, and interlock with, the recesses of an overlying block, thereby obviating the need for any securing mortar between courses. Such blocks may be used to construct building structures and are also used with increasing popularity in developing countries to reduce building costs by decreasing the time required to complete the structure. Walls made from interlocking blocks are also gaining acceptance in zones having seismic activity.

The corner and end blocks in accordance with the invention are intended to be used with a system of interlocking building blocks of the kind which is fully described in Applicant's co-pending U.S. application Ser. No. 08/850,105, the contents of which are incorporated herein by reference. In constructing walls using mortarless blocks, it becomes particularly important to reinforce the resulting structure by grouting the cavity defined inside vertically-adjacent blocks with concrete reinforced with structural steel bars. Such reinforcement is particularly desirable at corners, at wall ends, as well as at spaced locations along the length of a wall structure.

While interlocking building blocks are known, there are surprisingly few block structures which are specifically designed to maximize strength at wall ends and corners.

Important factors in maximizing strength are that the block define a relatively large cavity so as to be adapted to receive a proportionately large volume of grout; that the block have means to positively locate its position relative to other blocks so that it will not shift after being laid; and that the block have means to readily receive and locate structural steel reinforcement bars. Without such features, the strength and reliability of the resulting building structure are compromised.

U.S. Pat. No. 4,372,091 to Brown et al teaches an interlocking block structure having first and second face shells connected by spaced bridge portions having projections on a top surface and corresponding recesses on a bottom surface. The ends of the face shells may be closed by vertical inserts. The resulting structure has a very small grouting cavity which is formed between the insert and the proximate bridge portion. Positive location of the block when disposed at a corner is provided by an auxiliary bracket. There are no provisions for reinforcement bars.

U.S. Pat. No. 3,888,060 to Haener provides a specialized end block for use at corners and wall ends which has a larger grouting cavity than Brown et al, but which, likewise, cannot accommodate reinforcement bars without breaking an upwardly-extending tang portion which then allows the block to shift because there are no additional interlocks provided.

U.S. Pat. No. 4,319,440 to Rassias et al provides a large grouting cavity and structure to readily receive reinforcement bars through notches formed in outer and inner shells for the block, but there is no provision for interlocks to hold the blocks in position relative to each other until a reinforcement bar is placed in position and the blocks are grouted.

While all of the above-described blocks have some features which are desirable, there is a need for a block which will advantageously overcome their respective drawbacks.

An object of this invention is to provide a building block suitable for use at corners and end wall applications which will strengthen the resulting wall structure so that it is less vulnerable to collapse in adverse situations.

SUMMARY OF THE INVENTION

In accordance with this invention, there is provided an interlocking building block for use in constructing mortarless walls, the block having a first face shell in spaced relationship with a second face shell defining opposed inner surfaces for the block. The first and second face shells have a predetermined height. Between the face shells, there stands at least one transversely-disposed bridge portion and a transverse end portion which defines an operatively outer surface for the block which is adapted to close one end of the block between the first and second face shells and which is longitudinally-spaced from one transversely-disposed bridge portion to define a grouting cavity therebetween. Both the transversely-disposed bridge portions and the transverse end portion have integrally-formed projections which extend above the height of the block on an operatively-upper surface and corresponding recesses are formed in an operatively-lower surface of the block. Channels are formed in the opposed inner surfaces of the face shells which are adapted to receive and locate corresponding projections of an underlying interlocking block which is oriented orthogonally to the block, and the channels also define a reduced wall thickness in the first and second face shells which may be partially broken away to receive a reinforcement bar for reinforcing grout which is added to the grouting cavity in use.

BRIEF DESCRIPTION OF THE DRAWINGS

In order that the invention may be clearly understood, preferred embodiments thereof will be described below with reference to the accompanying drawings, in which.

DESCRIPTION OF PREFERRED EMBODIMENT WITH REFERENCE TO DRAWINGS

Figure 1:
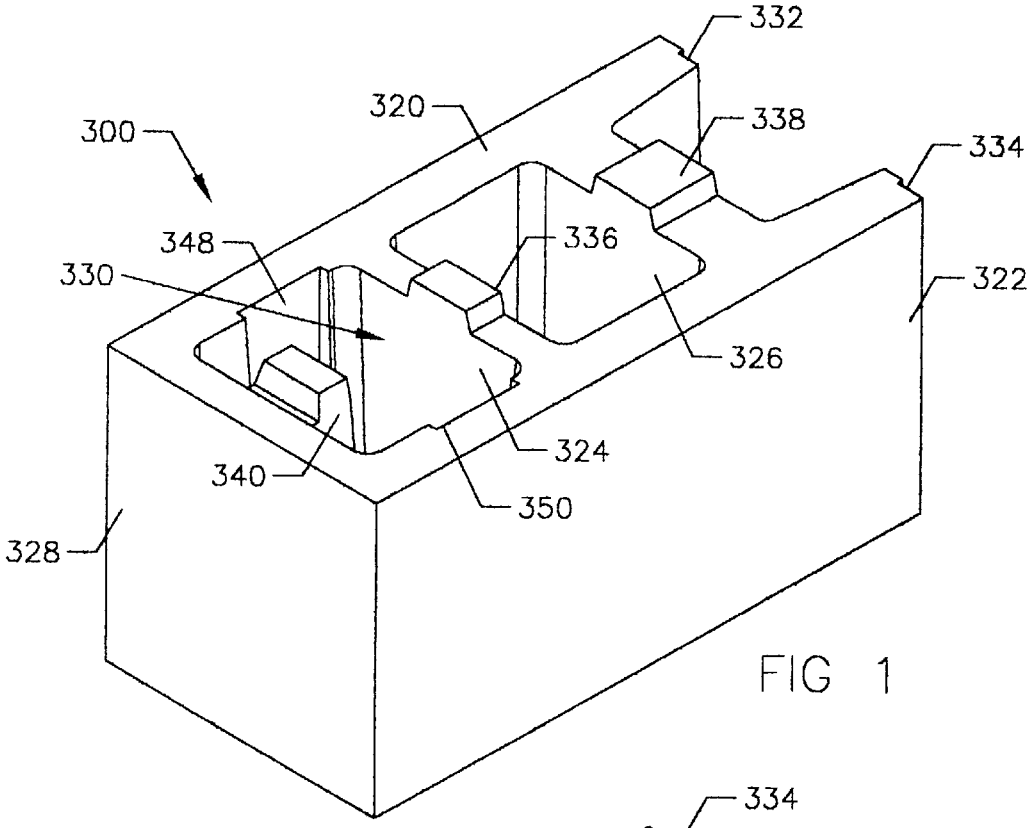
FIG. 1 is a perspective view from the top and to one side of a full end block made in accordance with the invention.

A full end block made in accordance with the invention is generally indicated in FIG. 1 by reference numeral 300. The block 300 is referred to as a full block because it has a full modular length which is adapted to cooperate with other full-length blocks or half-length blocks, as the case may be. The block 300 has first and second face shells 320, 322 which extend the length of the block and are spaced parallel to each other to define a width for the block. The separation between the first and second shells 320, 322 is maintained by a pair of transversely-disposed bridge portions 324, 326 which extend transversely between opposed inner surfaces of the first and second shells 320, 322.

A transverse end portion 328 is a special form of bridge portion which defines an operatively-outer surface for the block which, in the drawing, is planar but which could also be irregular in order to form a decorative surface. The transverse end portion 328 closes one end of the block 300 and is generally intended to be used to form an end wall or corner where the surface of the transverse end portion will be exposed. The transverse end portion 328 is longitudinally-spaced from the transverse bridge portion 324 so as to define a grouting cavity 330 therebetween. The grouting cavity 330 will, in use, be filled with a grouting concrete mixture in order to strengthen the resulting wall structure.

The first and second shells 320, 322 each have ends 332, 334 remote from the transverse end portion 328 which are profiled so as to cooperate with adjacent blocks disposed end to end. It will be seen that the second transverse bridge portion 326 is inwardly-spaced from said ends 332, 334 so that when the block 300 is disposed adjacent another block, another cavity will be formed.

Figure 2:
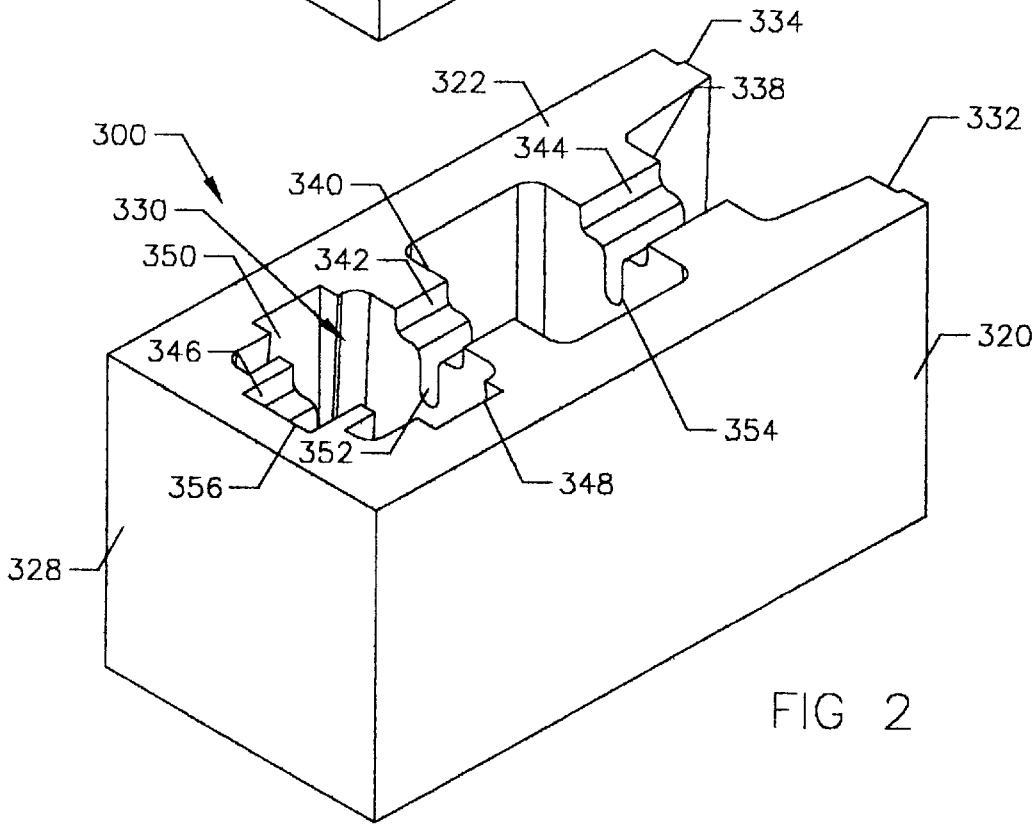
FIG. 2 is a similar view to FIG. 1 from the bottom and the opposite side of the block of FIG. 1.
Figure 3:
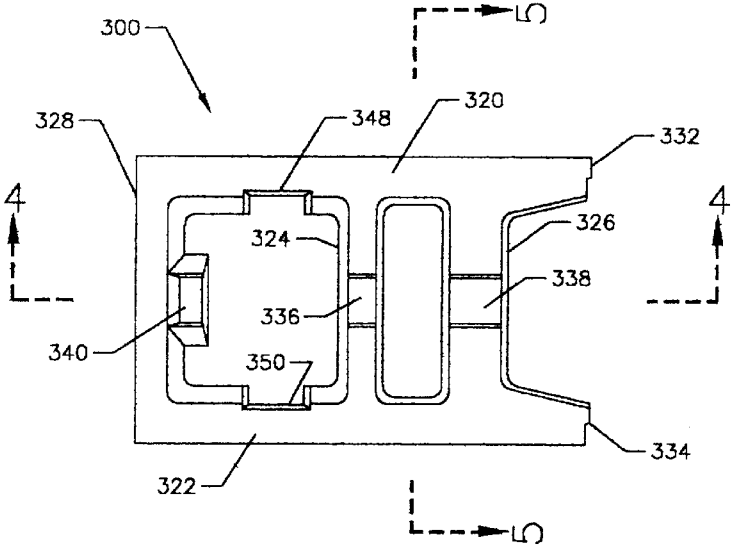
FIG. 3 (drawn to a smaller scale) is a top elevation view of the block of FIG. 1.
Figure 4:
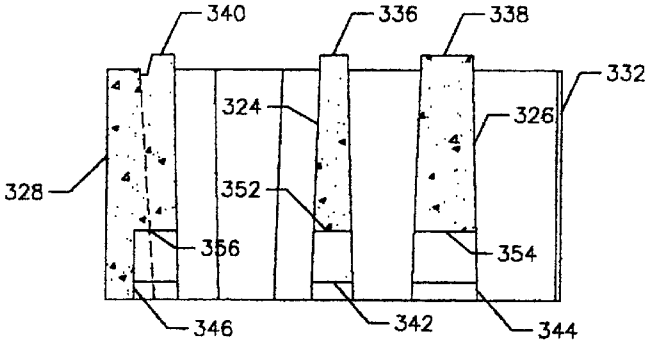
FIG. 4 is a cross-sectional view drawn on line 4—4 of FIG. 3.
Figure 5:
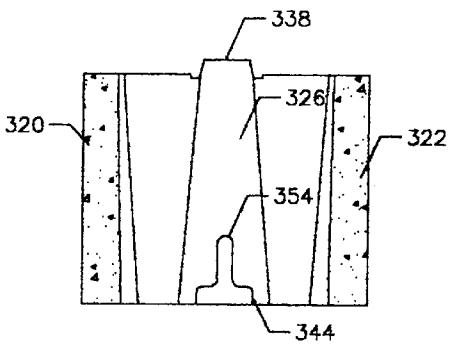
FIG. 5 is a cross-sectional view drawn on line 5—5 of FIG. 3.

The operatively-upper surfaces of the transverse bridge portion 324, 326 and the transverse end portion 328 each have respective, upwardly-extending projections identified in the drawings by numerals 336, 338, and 340 respectively. The projections extend above the height of the face shells 320, 322 and, in the case of projections 336, 340 adjacent the grouting cavity 330, are formed as a single tab having a rectangular cross-section. Projection 338 has a square cross-section of similar width to the projections 336, 340 but has a greater length corresponding to the length of the associated bridge portion 326. Corresponding recesses 342, 344, 346 are formed in the operatively-lower surface of the block, as will be seen in FIG. 2, and are adapted to receive the projections of an underlying building block oriented in parallel to the block 300. In order to accommodate the projections 336, 340 adjacent the grouting cavity 330 in a block oriented orthogonally to the block 300, a pair of vertically-extending channels 348, 350 are formed in the opposed inner surfaces of the first and second shells 320, 322 respectively. The channels 348, 350 extend upwardly from the bottom surface of the block and are disposed between the transverse end portion 328 and the proximate transversely-disposed bridge portion 342. Conveniently, the channels 348, 350 define a reduced wall thickness in the shells 320, 322 so that either or both shells may be partially broken to receive a reinforcement bar through the block, as will be described in more detail below, with reference to FIG. 12.

In order to accommodate a reinforcement bar which is received longitudinally in parallel to the face shells 320, 322, upwardly-extending grooves are formed in each of the recesses 342, 344, 346 and respectively designated by reference numerals 352, 354, and 356. The width of the grooves is selected to accommodate the diameter of a standard steel reinforcement rod.

Figure 6:
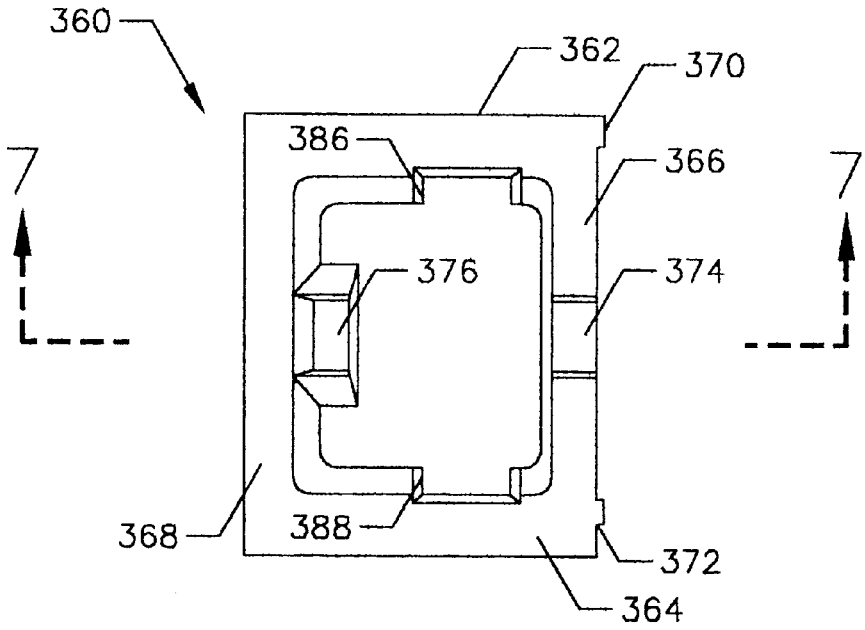
FIG. 6 is a top elevational view of a half end block made in accordance with the invention.
Figure 7:
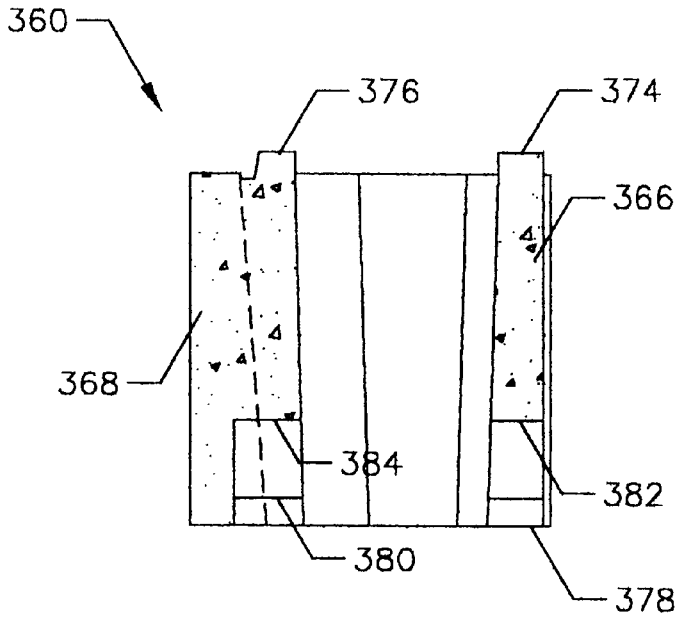
FIG. 7 is a cross-sectional view drawn on line 7—7 of the FIG. 6.

In an alternative embodiment of the invention, drawn in FIGS. 6 and 7, there is illustrated a half-end block 360 which, like the full-end block 300, has a first shell 362 which is spaced from and parallel to a second shell 364. The first and second shells 362, 364 are joined at one end by a single transverse bridge portion 366 and by a transverse end portion 368, at the other end, which defines an operatively-outer surface which is planar and adapted to close this end of the block between the face shells 362, 364. It will be seen that the face shells 362, 364 have ends 370, 372 which are remote from the transverse end portion 368 and integral with the transverse bridge portion 366. The ends 370, 372 are profiled in order to cooperate with adjacent blocks. The operatively-upper surface of the transverse bridge portion 366 and the transverse end portion 368 each have an integrally-formed, upwardly-extending projection 374, 376, respectively. Corresponding recesses adapted to receive the projections of an underlying block are formed in the operatively lower surfaces of the transverse bridge portion and the transverse end portion and are identified by reference numerals 378, 380, respectively, in FIG. 7. As in the full-end block 300 of FIGS. 1 to 5, upwardly-extending grooves 382, 384 are formed in the recesses 378, 380 and are dimensioned to receive a reinforcement bar.

Each of the face shells 362, 364 has a respective channel 386, 388 formed in opposed inner surfaces of the face shells and extending upwardly from the bottom surface of the block. The channels 386, 388 are adapted to receive and locate corresponding projections of an underlying interlocking block oriented orthogonally to the block 360.

In order that the use of the blocks may be better understood, reference will now be made to FIGS. 8 to 15 showing partial wall structures incorporating full-end blocks 300 and half-end blocks 360.

Figure 8:
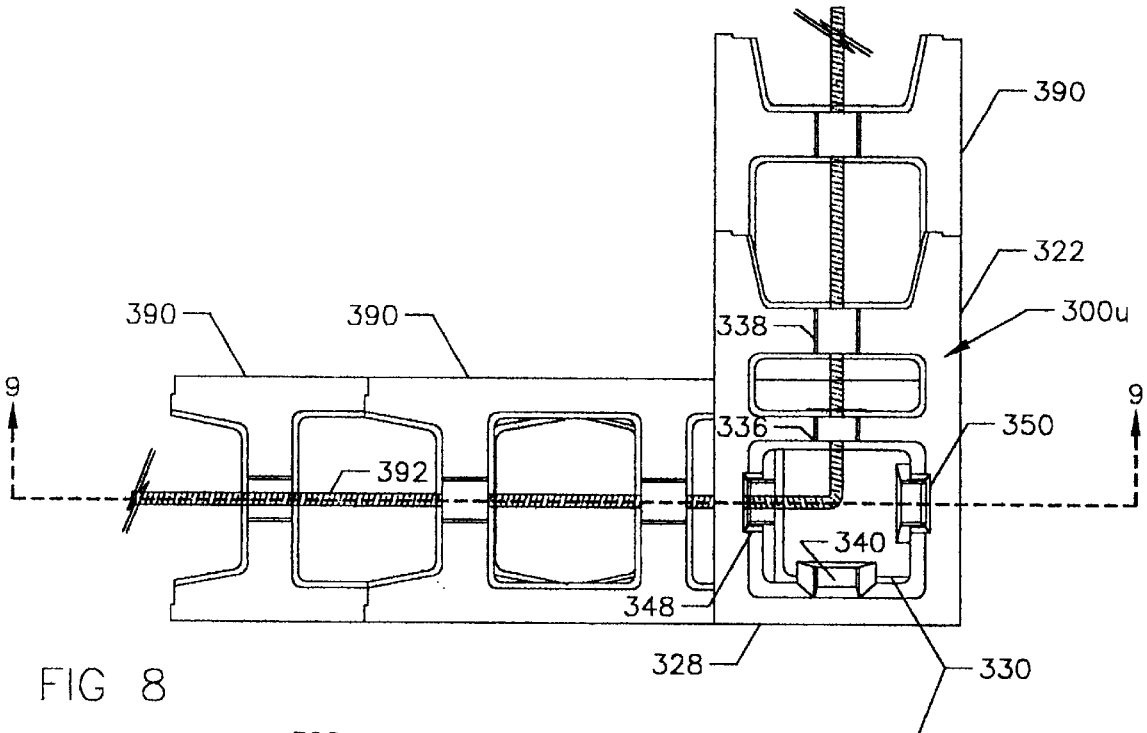
FIG. 8 is a top plan view of two courses of blocks forming a left-hand corner.
Figure 9:
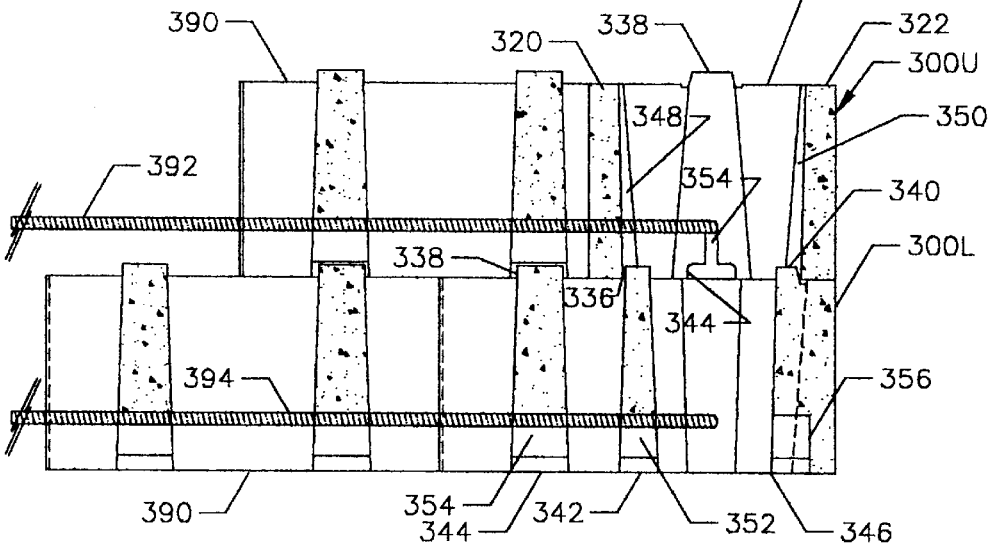
FIG. 9 is a cross-sectional view drawn on line 9—9 of FIG. 8.

In FIGS. 8, 9, a corner wall structure is shown where the overlying corner blocks are full-end blocks 300, each disposed adjacent full-length standard blocks 390 which are fully described in Applicant's co-pending U.S. application, Ser. No. 08/850,105, the contents of which are herein incorporated by reference. Reinforcement bars 392, 394 are disposed in the upper and lower courses of blocks respectively and are received in the grooves 352, 354 formed in the recesses formed in the operatively-lower surface of the blocks. At the corner, the channels 348, 350 of the full-end block 300U in the upper course receive the projections 336, 340 of the underlying block 300L.

Figure 10:
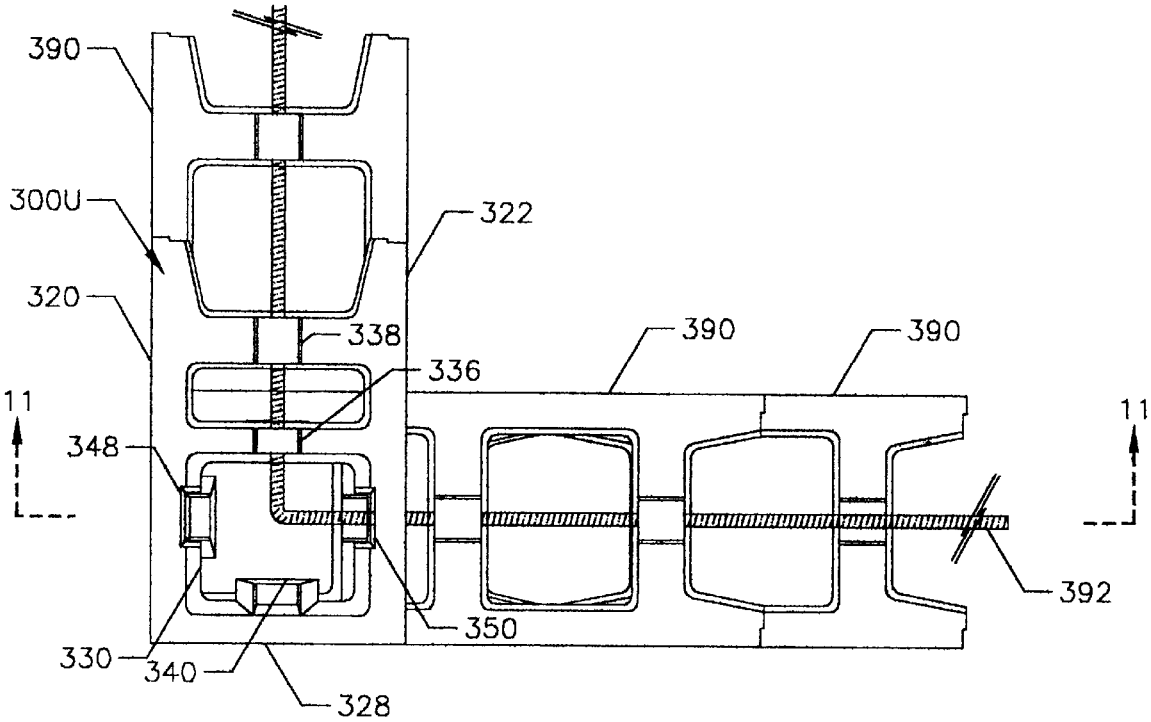
FIG. 10 is a similar view to FIG. 8 showing a right-hand corner.
Figure 11:
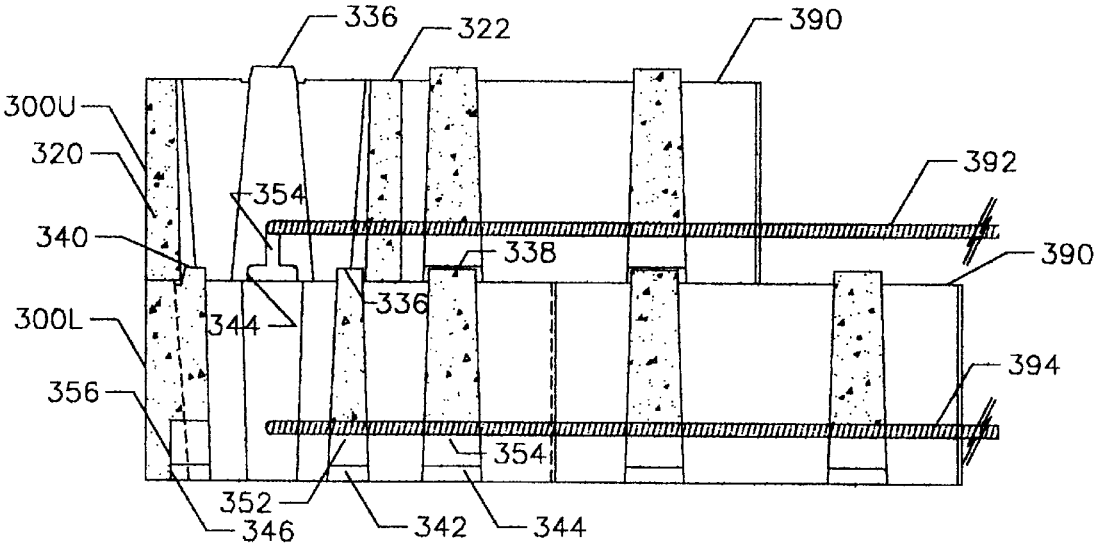
FIG. 11 is a cross-sectional view drawn on line 11—11 of FIG. 10.

It will be seen that the lower full-end block 300L is trapped by its projections 336, 340 in the channels 348, 350 of the upper full-end block 300U so that it will not shift after being laid. This is an important feature in defining a stable large-capacity grouting cavity 330. FIGS. 10 and 11 show the same block as in FIGS. 8 and 9 assembled to form a right-hand corner configuration and like parts have been identified by like reference numerals. In the drawings, it will be noted that the grouting cavity 330 is drawn free of grout for clarity in illustration. In use, the grouting cavity would normally be filled with a grouting concrete mixture.

Figure 12:
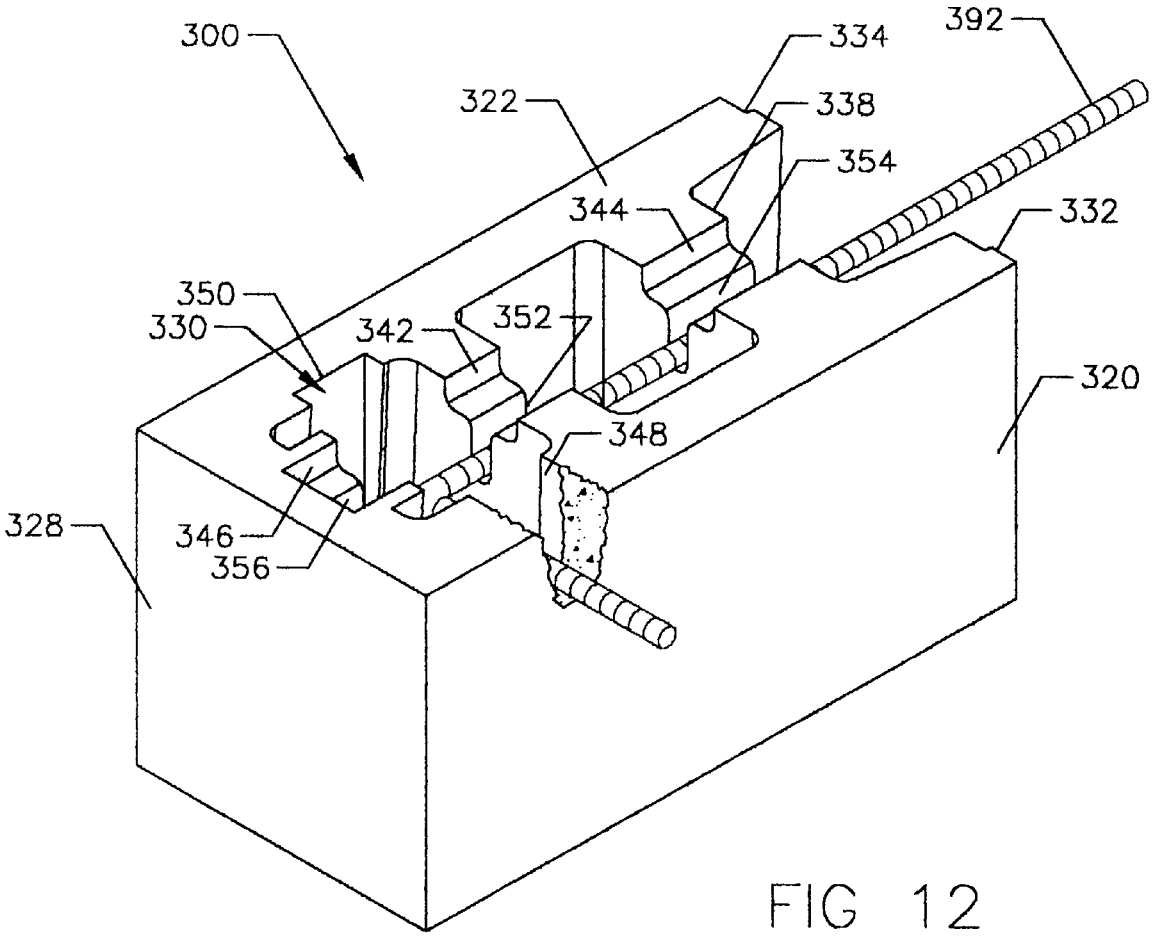
FIG. 12 (drawn to a larger scale) is a perspective view of a full end block showing a reinforcement bar received therethrough.

Preferably, the grouting cavity 330 is reinforced by placing the reinforcement bars 392, 394 into the block prior to grouting. In FIG. 12, a block 300 is shown in an upside-down orientation, that is, with its operatively lower surface drawn at the top, to show the placement of the reinforcement bar 392 into the grooves 352, 354. The bar 392 is bent at 90° in the grouting cavity 330 and emerges from the first face shell 320 through the channel 348 which has been partially broken away, as drawn. In this way, a continuous length of reinforcement bar may be placed in a respective course of blocks, without interruption. This is a very desirable feature which will improve the strength of the resulting building structure and its resistance to failure resulting from structural loading.

Figure 13:
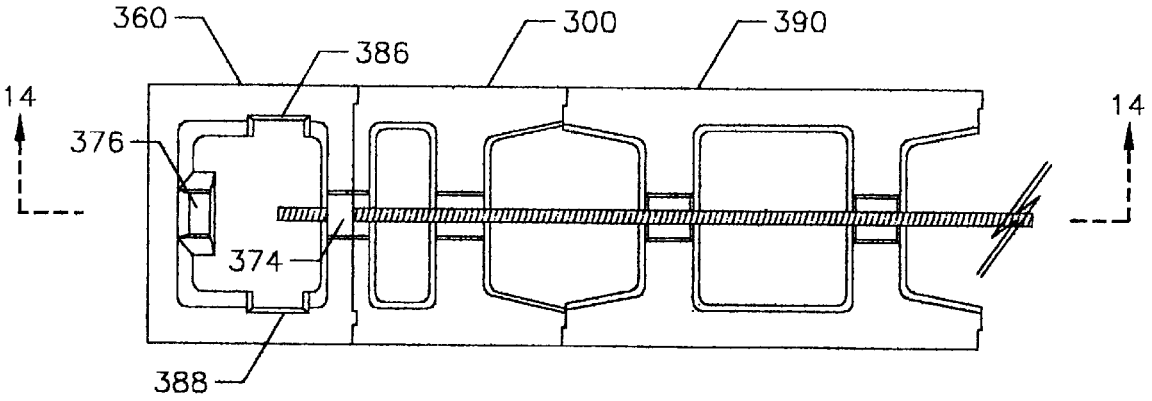
FIG. 13 is a top plan view of two courses of blocks forming an end wall.
Figure 14:
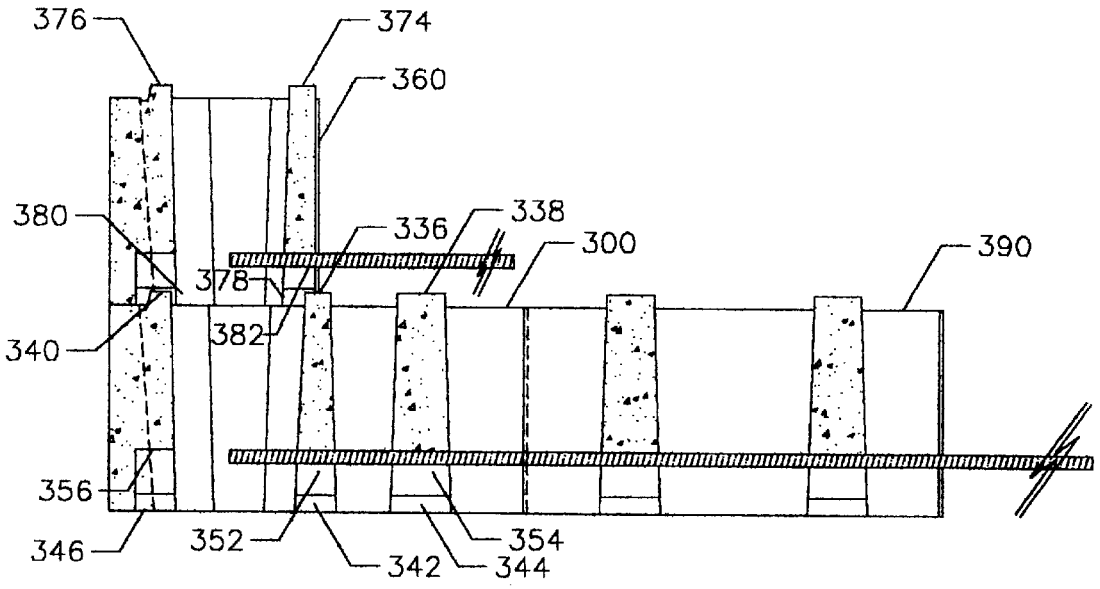
FIG. 14 is a cross-sectional view drawn on line 14—14 of FIG. 13.

In FIGS. 13 and 14 there is shown an end wall application in which the upper course of blocks comprises a single half-end block 360 disposed over a full-end block 300 which is placed end to end adjacent to a full standard block 390.

Figure 15:
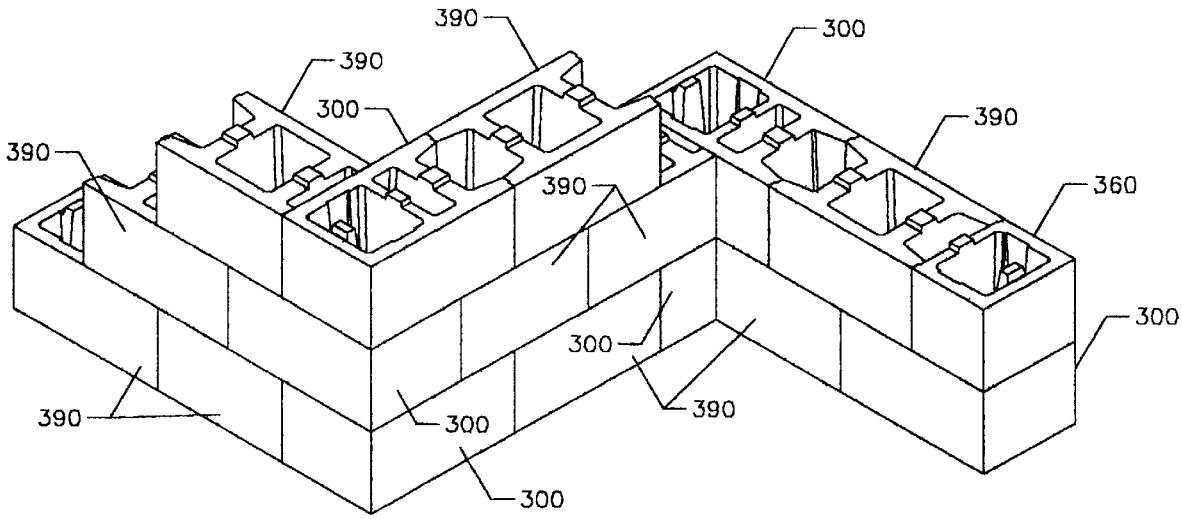
FIG. 15 is a perspective view showing three courses of blocks forming a corner and an end wall.

Finally, FIG. 15 shows an exemplary wall structure incorporating a corner formed with full-end blocks 300 and an end wall formed with full-end blocks 300 and half-end blocks 360. The remaining blocks of the structure are full standard blocks 390.

It will be understood that several variations may be made to the above-described embodiments of the invention within the scope of the appended claims. The relative width and length of the block may be varied according to the required application, the number and shape of the projections and corresponding recesses may also vary without departure from the claims. An important feature of the invention which is maintained in both of the above-described embodiments is that a transverse bridge portion is sufficiently spaced from the transverse end portion to define a large-size grouting cavity which will, in use, be reinforced by pouring a concrete grouting mixture into the cavity. For additional reinforcement, reinforcement bars will traverse the grouting cavity and are accommodated in grooves which are formed in the recesses at the operatively-lower surface of the blocks for receiving projections which extend upwardly from the operatively-upper surfaces of underlying blocks. The blocks are positively located by their projections and corresponding recesses or channels when the blocks are disposed orthogonally with respect to each other. Additional entry and exit points for reinforcement bars are provided by the reduced wall thicknesses formed by the channels.

I claim:

1. An interlocking building block for use in constructing mortarless walls, the building block having a first face shell in spaced parallel relationship with a second face shell, said first and second face shells defining opposed inner surfaces for the block, and having a predetermined height;

at least one transversely-disposed bridge portion extending between said first and second face shells, said transversely-disposed bridge portion having at least one projection integrally formed in an operatively-upper surface thereof and extending above said predetermined height and at least one corresponding recess integrally formed in an operatively-lower surface thereof and adapted to receive a corresponding number of projections of an underlying interlocking building block; and a transverse end portion defining an operatively outer surface closing one end of the block between the said first and second face shells and longitudinally-spaced from a proximate one of said transversely-disposed bridge portions to define a grouting cavity therebetween, said transverse end portion having at least one projection integrally formed in an operatively-upper surface thereof and extending above said predetermined height and having at least one corresponding recess integrally formed in an operatively-lower surface thereof and adapted to receive a corresponding number of projections of an underlying interlocking building block oriented in parallel to said block;

respective upwardly-extending channels being formed in said opposed inner surfaces between said transverse end portion and a proximate one of said transversely-disposed bridge portions, said channels being adapted to receive and locate corresponding projections of an underlying interlocking building block oriented orthogonally to said block, said channels further defining a reduced wall thickness in said first and second face shells adapted to be partially broken and to receive a reinforcement bar therethrough for reinforcing grout received in said grouting cavity.

2. An interlocking building block according to claim 1 in which said at least one projection is in the form of a single tab having a rectangular cross-section.

3. An interlocking building block according to claim 1 in which the first and second face shells have ends remote from said transverse end portion which are profiled to cooperate with profiled ends of adjacent interlocking building blocks.

4. An interlocking building block according to claim 1 having at least one groove extending upwardly through the operatively lower surface of said at least one transversely-disposed bridge portion, said at least one groove being adapted to accommodate a reinforcement bar traversing said at least one transversely-disposed bridge portion.

5. An interlocking building block according to claim 4 in which the groove extends upwardly through a respective recess in the bridge portion.

6. An interlocking building block according to claim 1 having a single transversely-disposed bridge portion spaced from said transverse end portion and disposed adjacent ends of said first and second face shells remote from said transverse end portion.

7. An interlocking building block according to claim 1 having a pair of transversely-disposed bridge portions longitudinally-spaced from each other, a first transversely-disposed bridge portion being spaced from said transverse end portion to define a grouting cavity therebetween, and a second transversely-disposed bridge portion being inwardly spaced from ends of the first and second face shells to define a cavity with an adjacent block.

8. Interlocking building block for use in constructing mortarless walls, the building block having a first face shell in spaced parallel relationship with a second face shell, said first and second face shells defining opposed inner surfaces for the block, and having a predetermined height;

at least one transversely-disposed bridge portion extending between said first and second face shells, said transversely-disposed bridge portion having at least one projection integrally formed in an operatively-upper surface thereof and extending above said predetermined height and at least one corresponding recess integrally formed in an operatively-lower surface thereof and adapted to receive a corresponding number of projections of an underlying interlocking building block, at least one groove extending upwardly through the operatively lower surface of said at least one transversely-disposed bridge portion, said at least one groove being adapted to accommodate a reinforcement bar traversing said at least one transversely-disposed bridge portion; and a transverse end portion defining an operatively outer surface closing one end of the block between the said first and second face shells and longitudinally-spaced from a proximate one of said transversely-disposed bridge portions to define a grouting cavity therebetween, said transverse end portion having at least one projection integrally formed in an operatively-upper surface thereof and extending above said predetermined height and having at least one corresponding recess integrally formed in an operatively-lower surface thereof and adapted to receive a corresponding number of projections of an underlying interlocking building block oriented in parallel to said block;

respective upwardly-extending channels being formed in said opposed inner surfaces between said transverse end portion and a proximate one of said transversely-disposed bridge portions, said channels being adapted to receive and locate corresponding projections of an underlying interlocking building block oriented orthogonally to said block, said channels further defining a reduced wall thickness in said first and second face shells adapted to be partially broken and to receive a reinforcement bar therethrough for reinforcing grout received in said grouting cavity.

9. An interlocking building block according to claim 8 in which the groove extends upwardly through a respective recess in the bridge portion.

* * * * *